US005765968A

United States Patent [19]

Lee

[11] Patent Number: 5,765,968

[45] Date of Patent: Jun. 16, 1998

[54] APPARATUS FOR ELIMINATING AND PREVENTING MARINE GROWTH ON OFFSHORE STRUCTURES

[75] Inventor: Choon Hwang Lee, Kuala Lumpar, Malaysia

[73] Assignees: Petronas Research & Scientific Services SDN. BHD, Selangor; Impact Surge SDN. BHD., Kuala Lumpur, both of Malaysia

[21] Appl. No.: 571,460

[22] Filed: Dec. 13, 1995

[30] Foreign Application Priority Data

Dec. 13, 1994 [MY] Malaysia ..... PI 9403322

[51] Int. Cl.[6] ..... B63C 11/52; B08B 9/02

[52] U.S. Cl. ..... 405/211; 15/104.04; 405/195.1

[58] Field of Search ..... 405/211, 158, 405/195.1, 212, 60, 216, 213, 214, 215; 15/104.04

[56] References Cited

U.S. PATENT DOCUMENTS

| | | | |
|---|---|---|---|
| 1,036,907 | 8/1912 | Reynolds | 405/211 |
| 1,134,881 | 4/1915 | Lockwood | 405/211 |
| 1,266,050 | 5/1918 | Reynolds | 405/211 |
| 1,266,051 | 5/1918 | Reynolds | 405/211 |
| 1,279,732 | 9/1918 | Lockwood | 405/211 |
| 1,611,920 | 12/1926 | Kinzbach | 15/104.04 X |
| 1,815,573 | 7/1931 | McManis | 15/104.04 |
| 5,026,212 | 6/1991 | Do | 405/211 |

*Primary Examiner*—Dennis L. Taylor
*Attorney, Agent, or Firm*—Ladas & Parry

[57] ABSTRACT

An apparatus powered by waves, currents, or tides for eliminating or preventing marine growth on a structure. The apparatus includes (a) at least one ring adapted to surround a submerged support member of the structure, the at least one ring being substantially continuous; (b) at least one pair of rollers rotatable against a surface of the support member for cleaning the surface of the support member; and (c) a linking member for linking the roller means to the ring without interrupting continuity of the substantially continuous ring and for allowing rotation of the rollers against the surface of the support member in response to forces generated by the waves, currents or tides.

17 Claims, 8 Drawing Sheets

APPARATUS FOR ELIMINATING AND PREVENTING MARINE GROWTH ON OFFSHORE STRUCTURES

TECHNICAL FIELD OF THE INVENTION

The present invention relates in general to an apparatus for elimination and prevention of marine growth affecting marine platforms, underwater structures and the like, and more particularly to a cost-effective means for the elimination and prevention of such growth by use of ocean natural forces to power the apparatus.

BACKGROUND OF THE INVENTION

Marine growth, in particular hard-fouling organisms such as barnacles, oysters and tubeworms together with soft-fouling organisms such as anemones and hydroid sponges, have long been recognized as a major cause of problems which affect the integrity of structures submerged in seawater in a number of ways, as is known to a person skilled in the art.

Periodical removal of such marine fouling by careening and scraping has been employed as a principal means of controlling marine growth fouling on offshore oil platforms for decades. Traditionally, copper-plating and later, Muntz metal-placing were used on ships' hulls and recently, marine growth inhibition has again been realized by the introduction of anti-fouling paints and other anti-fouling materials such as plates or panels of cupro-nickel tightly fitted to cleaned members. These methods however; have become prohibitively expensive both because of the time-consuming and costly diving operations involved and also the anti-fouling materials used.

More recent efforts in this field are seen in U.S. Pat. No. 5,026,212 and U.S. Pat. No. 5,040,923.

U.S. 5,026,212 discloses an apparatus for combatting marine growth on off-shore structures using flexible rings made of linkages pivotally joined together to form the rings. This apparatus is massive and messy because the linkages have to be strong and big enough to knock down marine growth. Moreover, the hinged joints are subjected to tremendous forces of the ocean that make the apparatus unreliable. In terms of efficiency, this apparatus is not very efficient because it only utilizes waves but does not tap water-current or tides as no means for tapping those forces are provided.

U.S. Pat. No. 5,040,923 discloses an apparatus for preventing the re-growth of marine fouling on marine structures which have been cleaned by apparatus as described in U.S. Pat. No. 5,026,212. This apparatus works basically on the same principle as the earlier apparatus, the only difference lies in the provision of brushes to prevent re-growth in place of scraping bar on the linkages. Fin means are provided to rotate the apparatus in response to water-currents or tides, but otherwise experience the same drawbacks as the previous apparatus.

SUMMARY OF THE INVENTION

Accordingly, it is the object of the present invention to provide an apparatus for eliminating and preventing marine growth on off-shore marine structures which is easier to manufacture, transport and assemble and at the same time overcome the drawbacks experience in prior art practice.

According to the most general aspect of the present invention, the object is accomplished by an apparatus for eliminating marine growth on off-shore structures and the likes, said apparatus consisting of at least one ring and adapted to surround a submerged support member of said structures, said apparatus utilizing ocean natural forces such as waves, currents and tides, comprising:

said at least one ring being made of at least a single piece fastened together at its ends by at least one fastening means; and optionally at least one roller means dismantlably attached to said at least one ring; said at least one roller means comprising a pair of rollers link together by a linking member so as to be rotatable along the circumferential edge of submerged support member. When the members are already cleaned from all marine-fouling, the same apparatus can be modified to act as preventer for new growth. To use as a preventer, the apparatus is installed surrounding the submerged support member in the same manner but is equipped with brush means. Advantageously, blade means are installed to cause the apparatus to rotate for a better cleaning of the fouling.

BRIEF DESCRIPTION OF THE DRAWINGS

Other aspects of the invention and their advantages will be discerned after studying the Detailed Description in-conjunction with the drawings in which.

DETAILED DESCRIPTION OF THE DRAWINGS

Figure 1A:
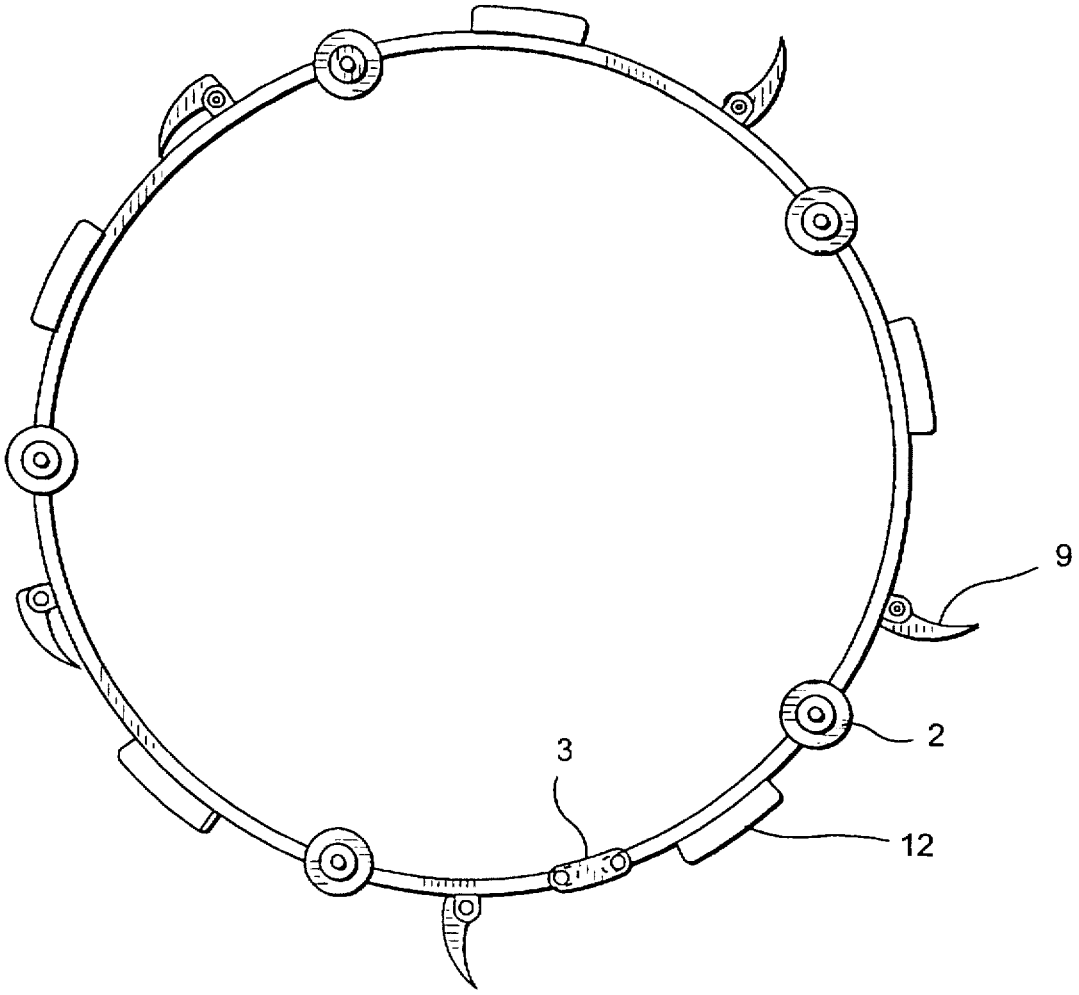
FIG. 1*a* showing plan view of eliminator apparatus according to one embodiment of the present invention, FIG. 1*b* showing side view of the eliminator apparatus FIG. 1*c* showing an array of rings to form another embodiment of the eliminator preventer apparatus.
Figure 1B:
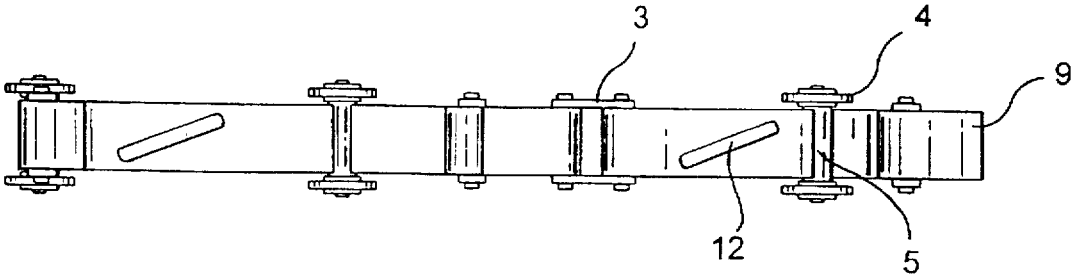

FIG. 1*a* and FIG. 1*b* show one embodiment of the present invention. It comprises of a ring 1 and roller means 2. The ring can be made from metal which is highly resistant to corrosion from sea water or can be made from flexible materials such as cords or the likes. Advantageously, the ring is made from extruded plastics with metal reinforcement. It can be made in a single piece bent and fastened at its ends with some known fastening means 3 to form the ring, or it can be made from several pieces and connected together by fastening means. The roller means 2, comprises of a pair of rollers 4 linked together by a linking member 5.

Figure 1C:
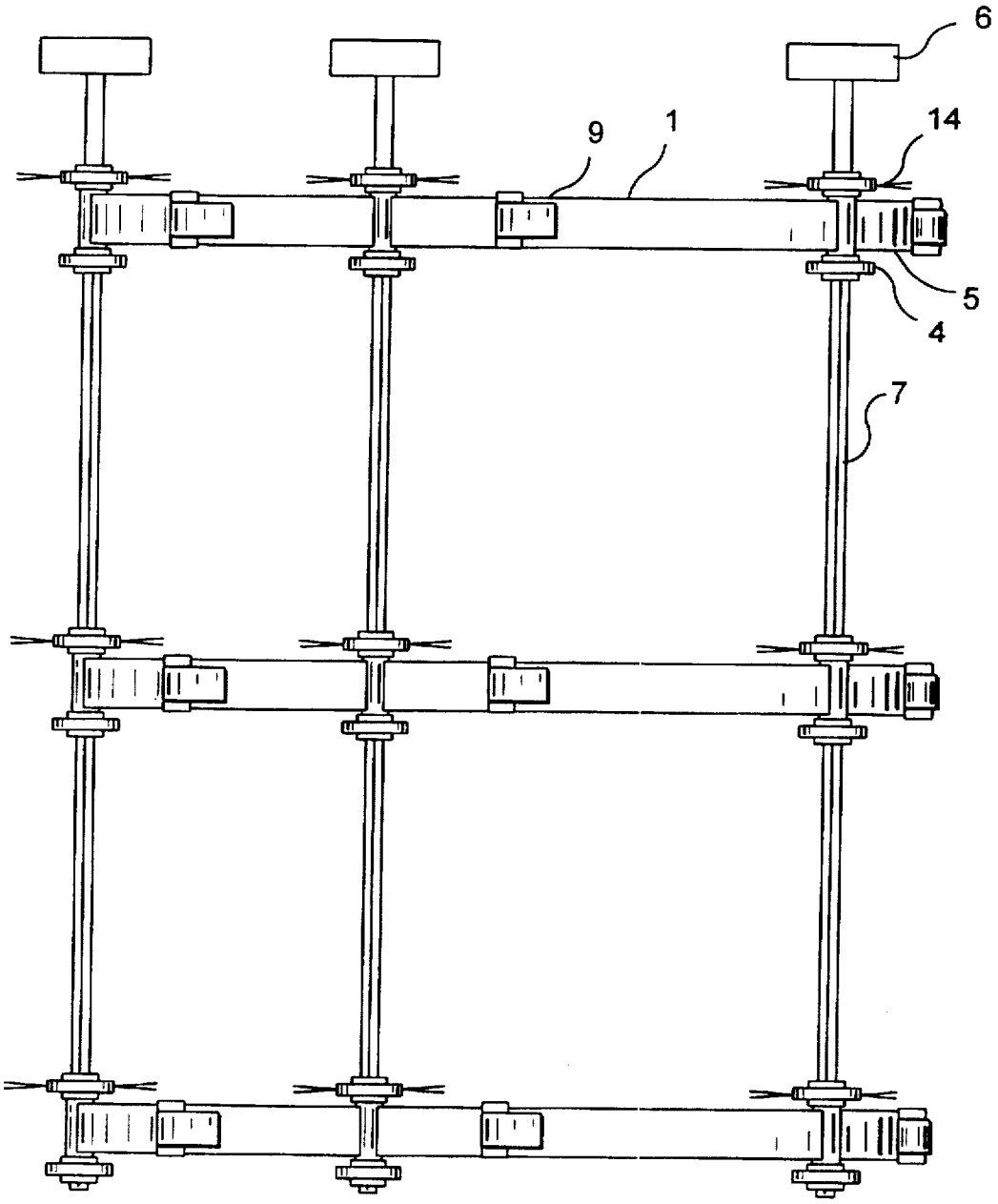
Figure 5:
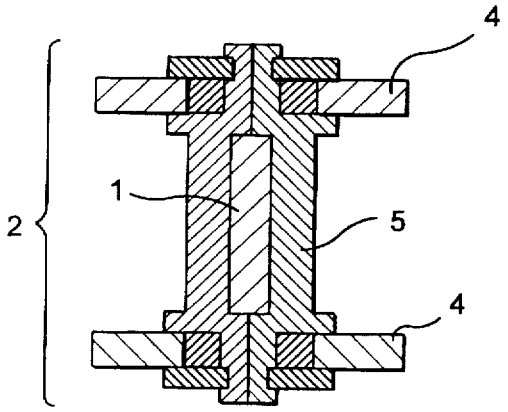
FIG. 5 showing roller means.

The linking member is made from two halves and is adapted to sandwich the ring when in use as shown in FIG. 5. FIG. 1*c* shows another form of use of the present invention. A plurality of rings are connected together by linking member 7 and is adapted to surround the submerged support structure. The number of rings and the depth to be used depend on the nature of the structure and also the sea condition. In some instances the whole length of the structure needs be surrounded by the apparatus for effective cleaning. Flotation means 6 keep the apparatus afloat.

Figure 2:
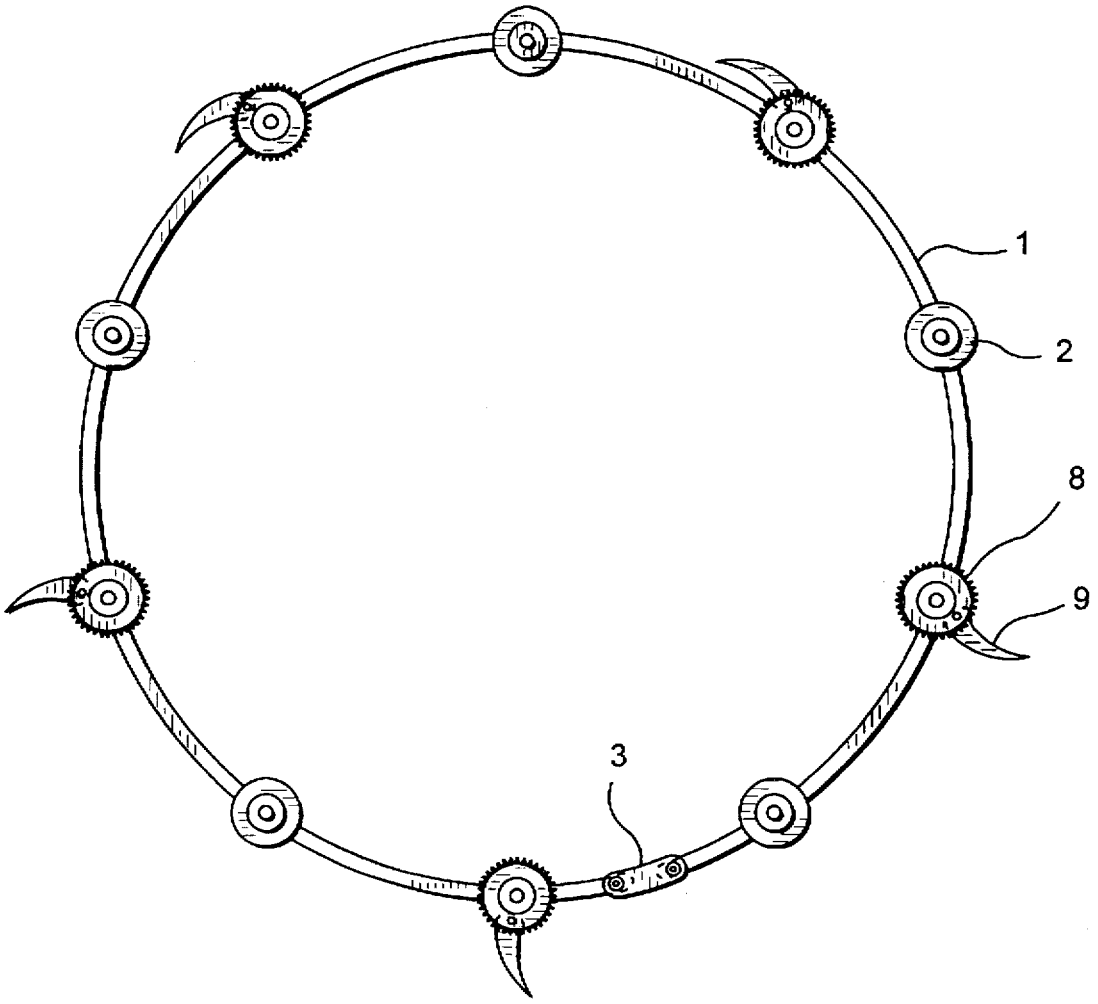
FIG. 2. showing plan view of the eliminator apparatus according to another embodiment of the present invention, FIG. 3*a* showing plan view of the ring when used as a preventer apparatus according to one embodiment of the present invention.

FIG. 2 shows another embodiment of the apparatus according to the present invention. For more effective operation of the apparatus, the roller means are provided with teeth 8. This can be done by serrated roller or providing teeth from some hard metal to surround the roller. A blade means is 9 is provided to cause the apparatus to rotate for better removing of fouling. The blade means is preferably hingedly attached to the roller so that the blades in the direction of water current will be opened to some predetermined opening to tap maximum force and those in the opposing direction will be closed to offer least resistant. Also, as the blades open or close, they rotate the roller slightly with respect to the ring for a better tearing effect on the fouling.

Figure 3A:
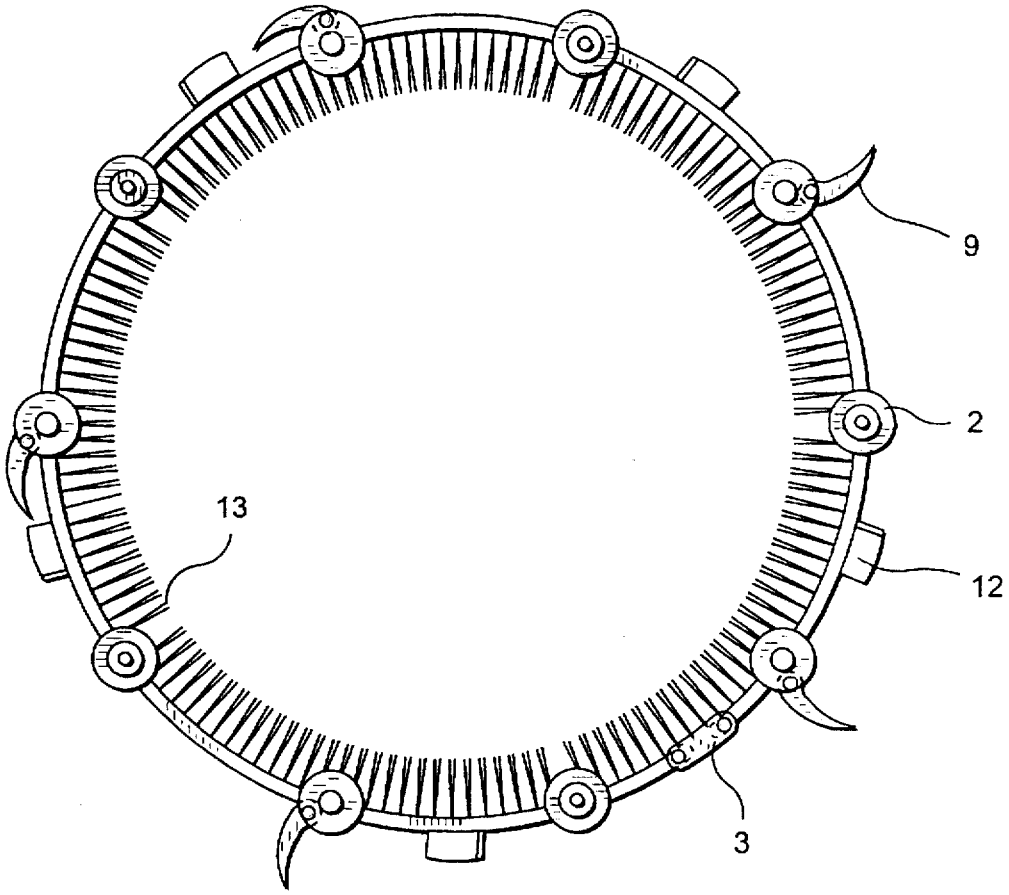
FIG. 3*b* showing side view of the preventer apparatus according to one embodiment of the present invention.
Figure 3B:
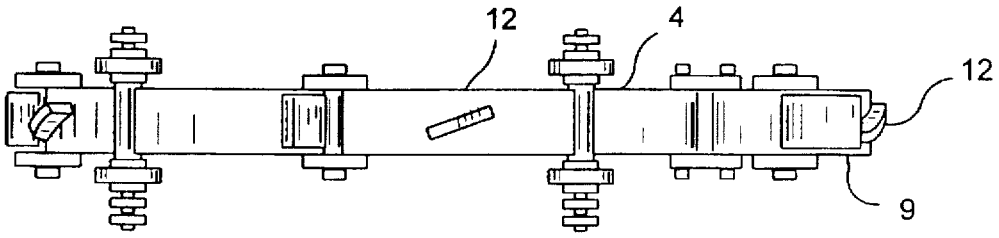
Figure 6A:
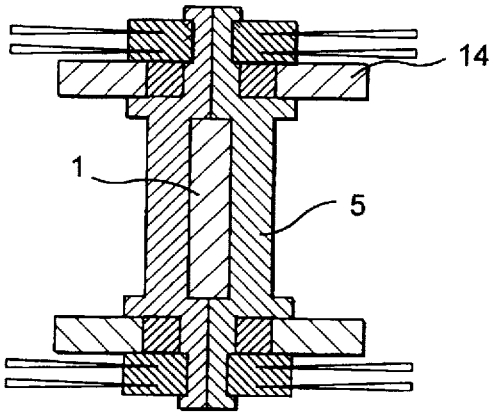
FIG. 6*a* showing roller brush means.
Figure 6B:
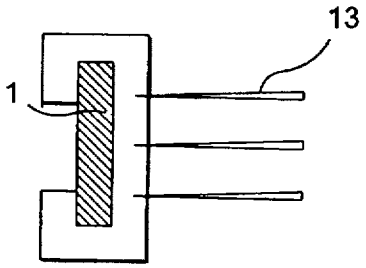
FIG. 6*b* showing dismantably brush means.
Figure 6C:
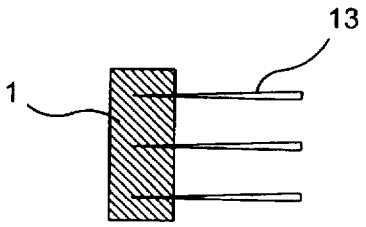
FIG. 6*c* showing planted brush means.

FIG. 3*a* and FIG. 3*b* show the apparatus of the present invention when use as a preventer of marine growth. The same ring as used in the eliminator is provided with brush means 13 for cleaning of the growth. The brush means can be planted to the ring as shown in FIG. 3*a* or can be dismantably attached to the ring as shown in FIG. 6*b*. First blade means 9 is provided for tapping water current to cause the apparatus to rotate. This first blade means can be hinged or fixedly joined to the ring or to the roller. A second blade means 12 is also provided to cause the apparatus to rotate and move in the direction of longitudinal axis of the submerged support member to be cleaned.

Figure 4A:
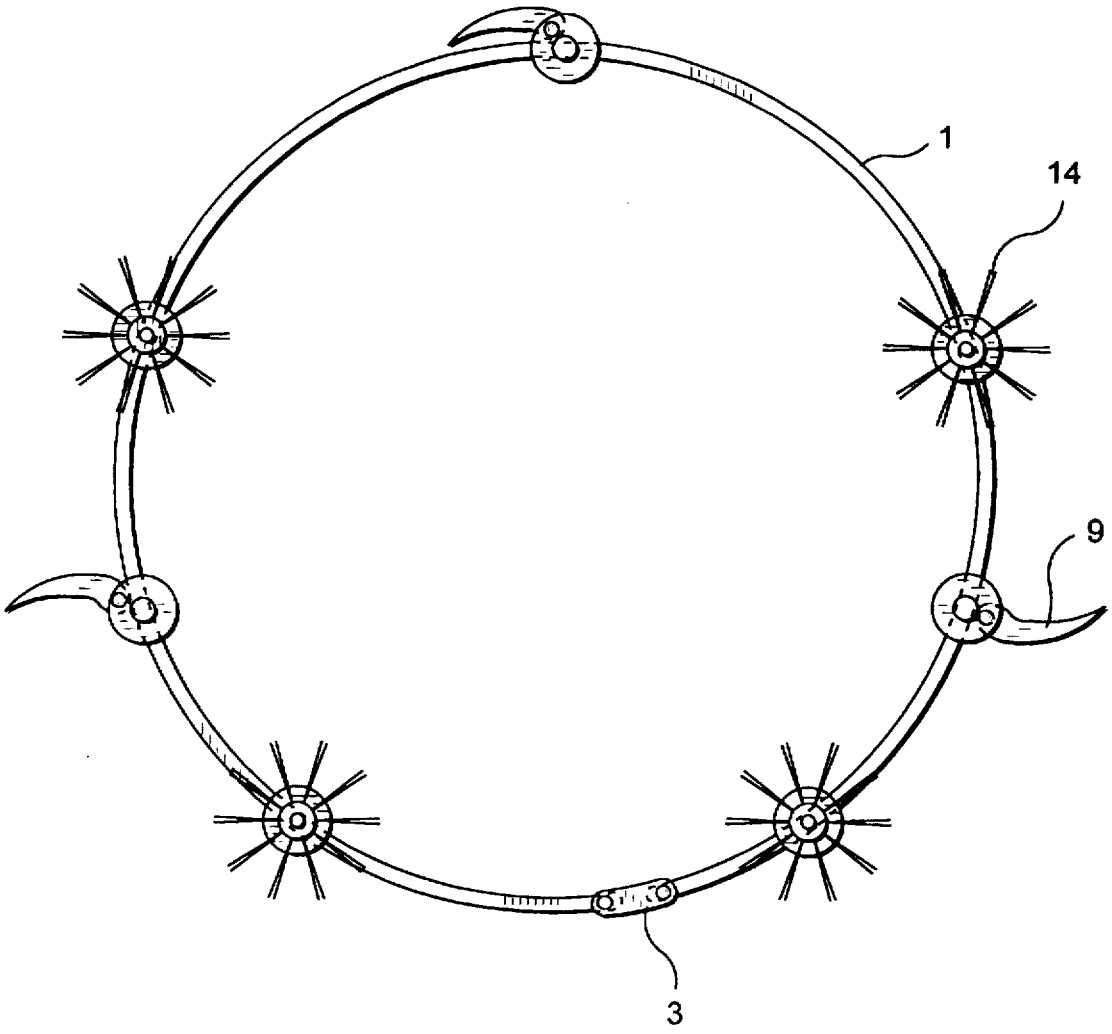
FIG. 4*a* showing plan view of the preventer apparatus according to another embodiment of the present invention.
Figure 4B:
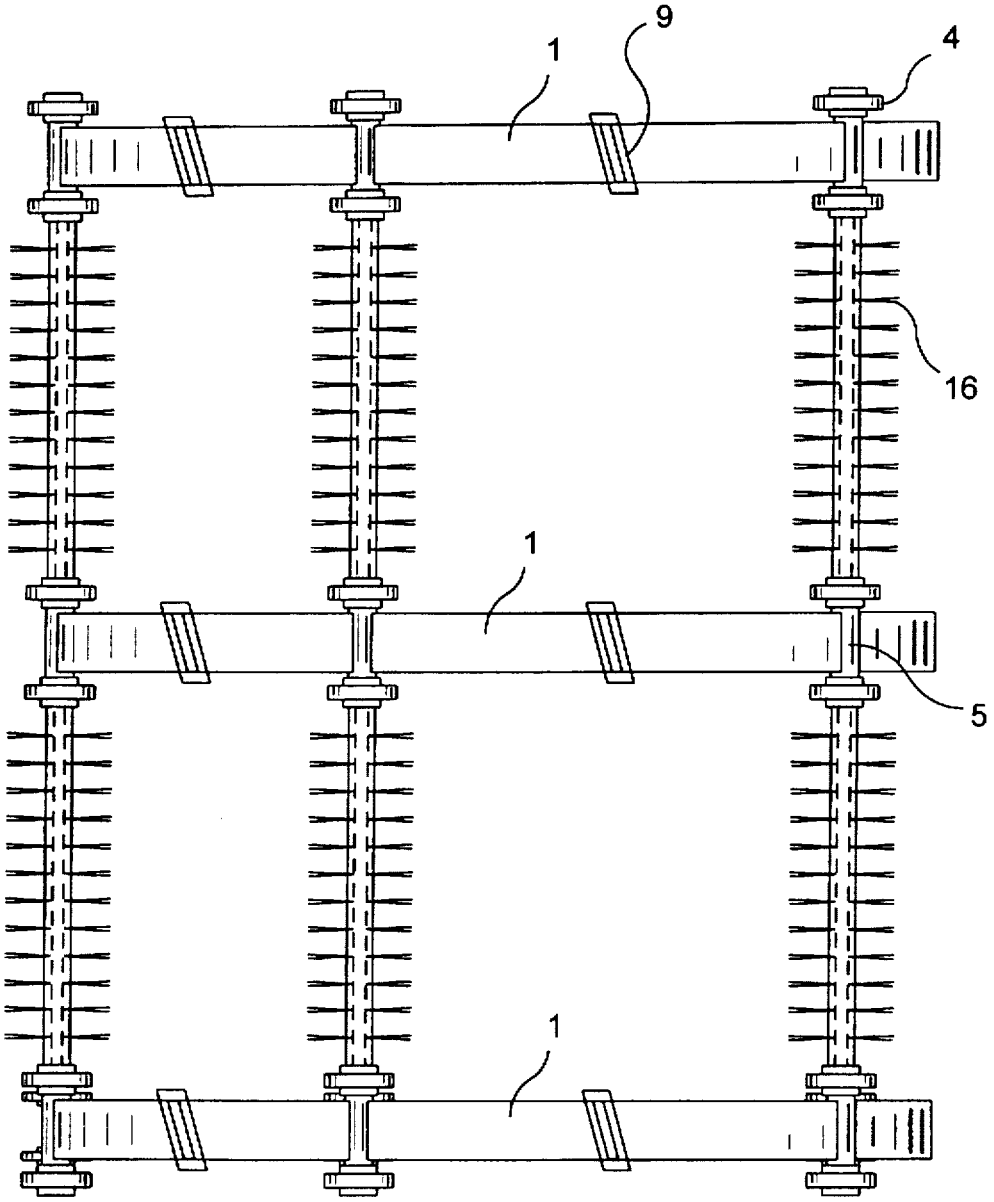
FIG. 4*b* showing side view of the preventer apparatus.
Figure 7:
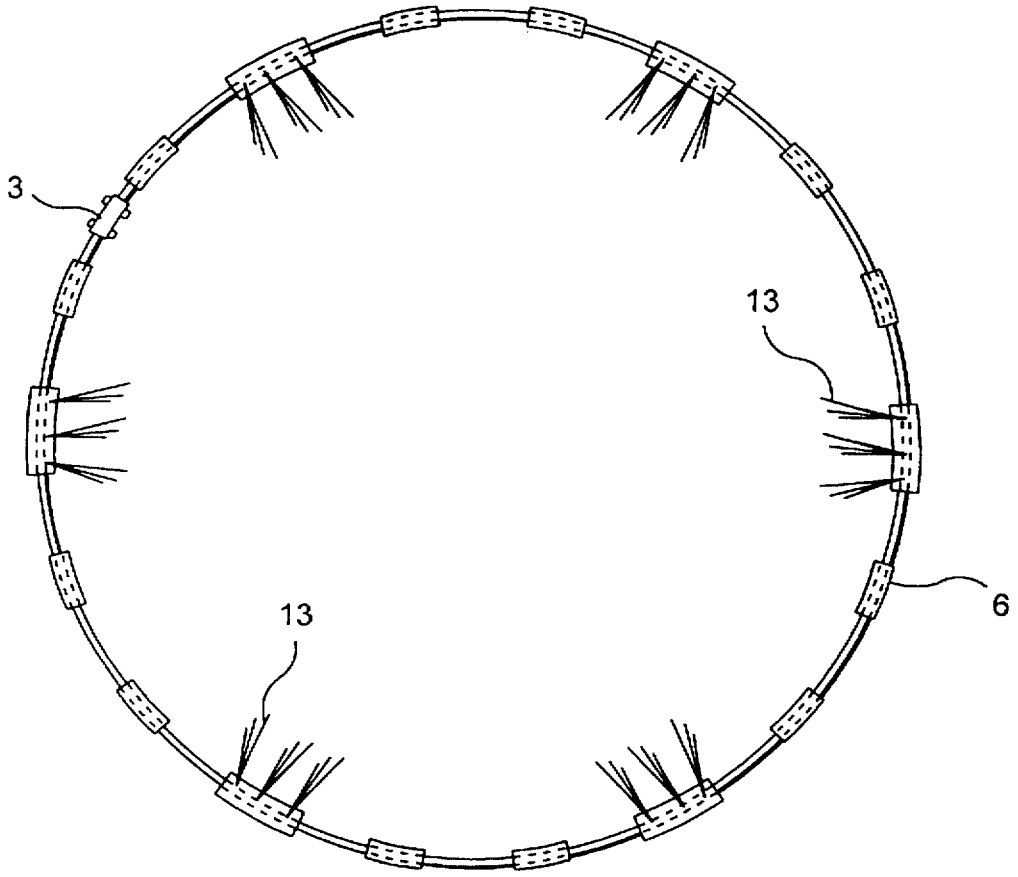
FIG. 7 is planing view of a preventer apparatus incorporating brushes
Figure 7A:
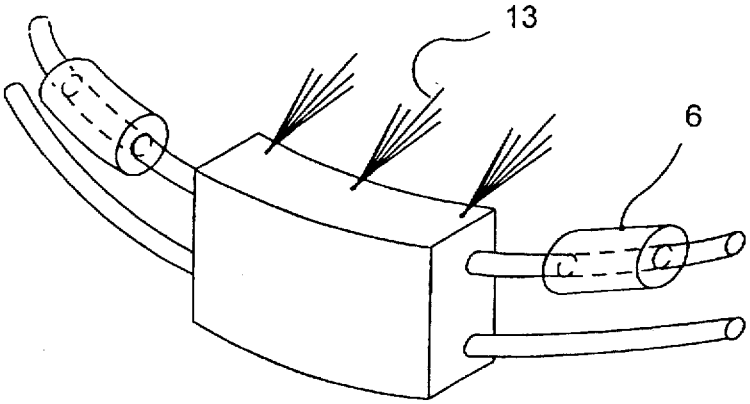
FIG. 7*a* is an enlarged isometric view of a portion of the apparatus shown in FIG. 7

FIG. 4*a* and 4*b* show another embodiment of the apparatus of the present invention. In one embodiment as shown in FIG. 6*a* the roller means can be equipped with brushes 14 to clean marine fouling as the rings rock along with the waves, and alsc as the rings rotate in response to water current. Blade means is provided to cause the rings to rotate. For obvious reasons it is sometimes advantageous to attach more than one ring to obtain better cleaning. When using a plurality of rings as a preventer, the rings are linked together by linking members. In one embodiment, the linking members are provided with brushes 16 to give the apparatus a bigger and wider brushing area and thus to increase the cleaning efficiency considerably. FIG. 7 is a plan view of a preventer apparatus incorporating brushes. The ring comprises a flexible cord or steel cable bound to form a ring. A pluavality of plastics or rubber materials are incorporated in the flexible cords or steel cable. The plastics or rubber materials include an assembly of radially pointing brushes.

In use the apparatus is adapted to surround a submerged support member. The apparatus will rock in response to wave and at the same time will rotate in response to water current, thereby tearing apart marine fouling and also preventing new growth.

While the preferred embodiment of the present invention and their advantages have been disclosed in the above detailed description, the invention is not limited thereto but only by the spirit and scope of the appended claim.

I claim:

1. An apparatus powered by waves, currents, or tides for eliminating or preventing marine growth on a structure, said apparatus comprising:

a) at least one ring adapted to surround a submerged support member of said structure, said at least one ring being substantially continuous;

b) at least one roller means rotatable against a surface of the support member for cleaning the surface of the support member; and c) linking means for linking the roller means to the ring without interrupting continuity of the substantially continuous ring and for allowing rotation of the roller means against the surface of the support member in response to forces generated by the waves, currents or tides.

2. An apparatus as claimed in claim 1 wherein the ring comprises a single piece of material having first and second ends, and fastening means for joining said first and second ends together in unhinged connection.

3. An apparatus as claimed in claim 1 wherein the ring comprises a plurality of pieces of material and a plurality of fastening means for joining said plurality of pieces together in unhinged connection.

4. An apparatus as claimed in claim 1 wherein the at least one roller means comprises a pair of rollers and the linking means comprises a linking member linking the pair of rollers.

5. An apparatus as claimed in claim 1 further comprising first blade means hingedly joined to the at least one roller means for causing the apparatus to rotate in response to the forces generated by the waves, currents or tides.

6. An apparatus as claimed in claim 1, wherein said at least one roller means comprises projecting means for tearing marine growth.

7. An apparatus as claimed in claim 4, wherein the at least one roller means comprises a plurality of rollers, and the first blade means comprises a plurality of blades with each of the blades being pivotally attached to a respective one of the plurality of rollers so that the blades move unidirectionally between open and closed positions in response to forces generated by the waves, currents or tides, each of said blades being disposed at a different position along a circumference of the ring such that a first of the blades is in the open position when a second of the blades is in the closed position.

8. An apparatus as claimed in claim 1 further comprising second blade means for causing the apparatus to rotate and move toward a longitudinal axis of the support member in response to the waves, currents or tides.

9. An apparatus as claimed in claim 1, wherein the at least one ring is made of a flexible material.

10. An apparatus powered by waves, currents, or tides for eliminating or preventing marine growth on a structure, said apparatus comprising:

a) at least one ring adapted to surround a submerged support member of said structure;

b) at least one roller means rotatable against a surface of the support member for cleaning the surface of the support member;

c) linking means for linking the roller means to the ring and for allowing rotation of the roller means against the surface of the support member in response to forces generated by the waves, currents or tides; and d) first blade means joined to the at least one roller means for causing the apparatus to rotate in response to the forces generated by said waves, currents or tides.

11. An apparatus as claimed in claim 9, wherein said at least one ring is made of a single piece fastened together at ends thereof by at least one fastener, said at least one ring comprising brush means for cleaning the surface of the support member.

12. An apparatus as claimed in claim 9, wherein the at least one roller means comprises a pair of rollers and the linking means comprises a linking member linking the pair of rollers.

13. An apparatus as claimed in claim 9, wherein the at least one roller means comprises a plurality of rollers, and the first blade means comprises a plurality of blades with each of the blades being pivotally attached to a respective one of the plurality of rollers so that the blades move unidirectionally between open and closed positions in response to the forces generated by the waves, currents or tides., each of said blades being disposed at a different position along a circumference of the ring such that a first of the blades is in the open position when a second of the blades is in the closed position.

14. An apparatus as claimed in claim 9 further comprising second blade means for causing the apparatus to rotate and move toward a longitudinal axis of the support member in response to the forces generated by the waves, current or tides.

15. An apparatus as claimed in claim 10, wherein the brush means is detachable from said at least one ring.

16. An apparatus as claimed in claim 10, wherein the brush means comprises a pair of roller brushes linked by a linking member.

17. An apparatus as claimed in claim 9, wherein said at least one ring comprises a flexible cord or cords, said apparatus further comprising a plastic or rubber material attached to the cord or cords and a plurality of radially pointing brushes.

* * * * *